US010329712B2

(12) United States Patent
Lammermann

(10) Patent No.: US 10,329,712 B2
(45) Date of Patent: Jun. 25, 2019

(54) ROTOR BOW COMPRISING A TUBULAR GUIDE ELEMENT, PARTICULARLY FOR A MACHINE FOR PROCESSING ELONGATE STRAND MATERIAL

(71) Applicant: MASCHINENFABRIK NIEHOFF GMBH & CO. KG, Schwabach (DE)

(72) Inventor: Helmut Lammermann, Schwabach (DE)

(73) Assignee: MASCHINENFABRIK NIEHOFF GMBH & CO. KG, Schwabach (DE)

( * ) Notice: Subject to any disclaimer, the term of this patent is extended or adjusted under 35 U.S.C. 154(b) by 37 days.

(21) Appl. No.: 15/502,560

(22) PCT Filed: Aug. 5, 2015

(86) PCT No.: PCT/EP2015/068046
§ 371 (c)(1),
(2) Date: Feb. 8, 2017

(87) PCT Pub. No.: WO2016/020433
PCT Pub. Date: Feb. 11, 2016

(65) Prior Publication Data

US 2017/0218566 A1 Aug. 3, 2017

(30) Foreign Application Priority Data

Aug. 8, 2014 (DE) ..... 10 2014 011 772

(51) Int. Cl.
*D07B 3/10* (2006.01)
*D01H 7/26* (2006.01)
*D01H 7/30* (2006.01)

(52) U.S. Cl.
CPC ..... *D07B 3/103* (2013.01); *D01H 7/26* (2013.01); *D01H 7/30* (2013.01); *D07B 3/10* (2013.01)

(58) Field of Classification Search
CPC ..... D07B 3/10; D07B 3/103; D07B 3/106; D07B 3/08; D07B 3/085; D07B 3/12;
(Continued)

(56) References Cited

U.S. PATENT DOCUMENTS 3,793,819 A * 2/1974 Madalozzo ..... D07B 3/10 57/58.52
6,223,513 B1 5/2001 Post et al.
(Continued)

FOREIGN PATENT DOCUMENTS

CH 618 486 A5 7/1980
CN 103125000 5/2013
(Continued)

OTHER PUBLICATIONS

International Search Report prepared by the European Patent Office dated Jan. 11, 2016, for International Application No. PCT/EP2015/068046.
(Continued)

*Primary Examiner* — Ismael Izaguirre
(74) *Attorney, Agent, or Firm* — Sheridan Ross P.C.

(57) ABSTRACT

Flyer bow for a wire-braiding or cable-twisting machine, comprising a bow member that has a groove extending essentially along the entire longitudinal extension of the flyer bow in the longitudinal direction of the flyer bow. The flyer bow comprises a tubular guiding element, especially a coil spring, for guiding the elongate strand-type material that is placed in the groove without interruption, essentially along the entire longitudinal extension of the groove. The inner dimensions of the groove at any point along the longitudinal extension of the guiding element are greater than or equal to the outer dimensions of the guiding element
(Continued)

Figure 1:
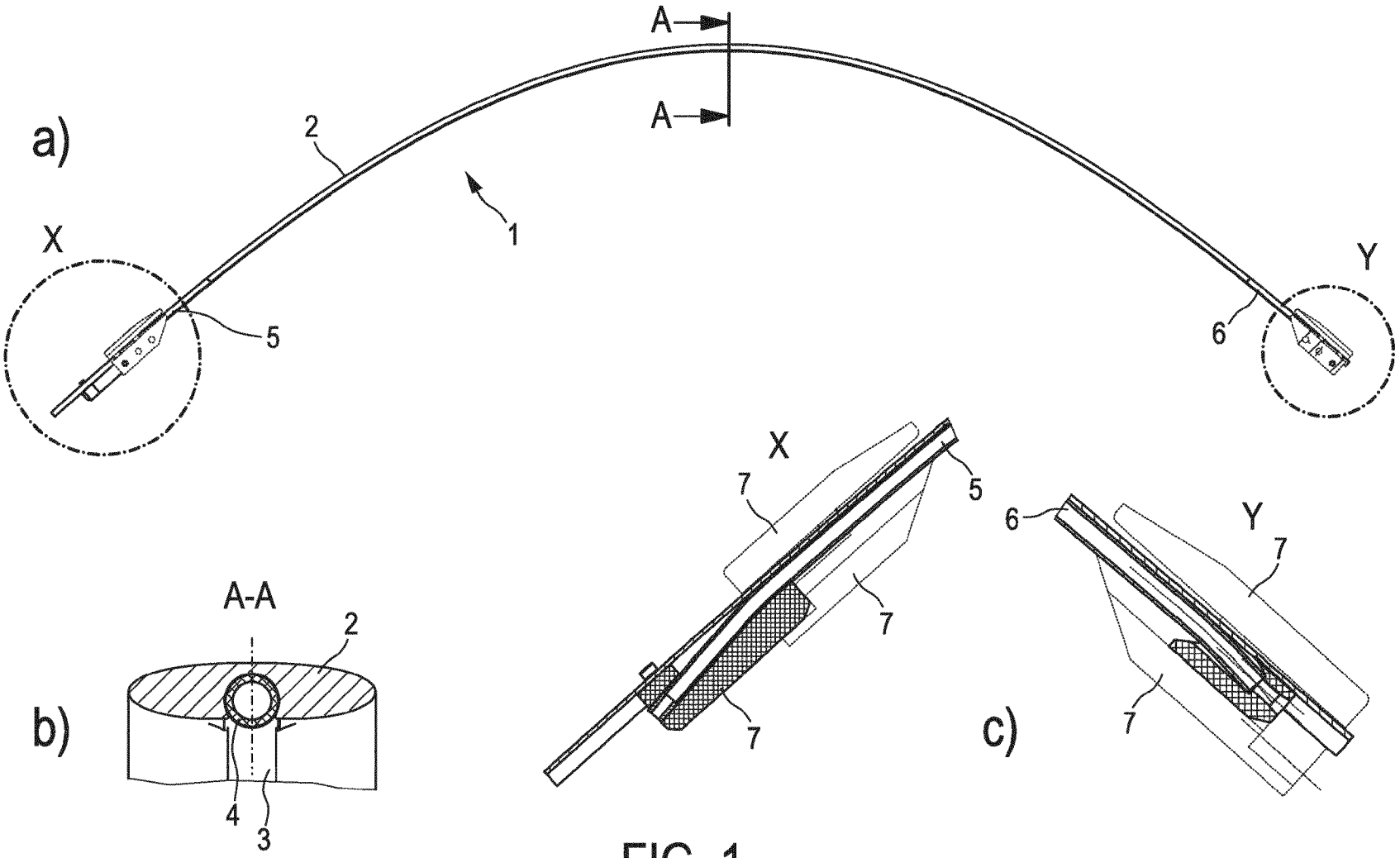

at the same point. This makes it easy to remove and introduce, preferably pull out and insert, the guiding element from and into the groove.

16 Claims, 5 Drawing Sheets

(58) Field of Classification Search
CPC .. D01H 7/26; D01H 7/24; D01H 7/30; D01H 7/32; D01H 7/46
See application file for complete search history.

(56) References Cited

U.S. PATENT DOCUMENTS 6,289,661 B1 * 9/2001 Boland ..... D07B 3/10 57/115
7,121,076 B2 * 10/2006 Priegelmeir ..... D07B 3/10 57/118
7,165,387 B2 * 1/2007 Voge ..... D01H 7/26 57/115
2006/0196163 A1 9/2006 Scranton et al.
2014/0196431 A1 7/2014 Boujaada et al.

FOREIGN PATENT DOCUMENTS

EP 1 612 325 A1 1/2006
JP 2002242086 A * 8/2002
JP 2009 242977 A 10/2009

OTHER PUBLICATIONS

English Translation of International Preliminary Report on Patentability for International (PCT) Patent Application No. PCT/EP2015/068046, dated Feb. 23, 2017, 12 pages.
Official Action with English Translation for China Patent Application No. 201580042558.9, dated Jun. 19, 2018, 25 pages.

* cited by examiner a)

| Twists/min [S/min] | Power consumption / prior art [kW] | Power consumption / spring coil [kW] | Energy savings [kW] |
|---|---|---|---|
| 1000 | 0.876 | 0.871 | 0.005 |
| 2000 | 1.356 | 1.312 | 0.044 |
| 3000 | 2.107 | 1.931 | 0.176 |
| 4000 | 3.311 | 2.825 | 0.486 |
| 5000 | 5.227 | 4.217 | 1.01 |
| 6000 | 8.045 | 6.191 | 1.854 |
| 6500 | 9.904 | 7.503 | 2.401 |

b)

ROTOR BOW COMPRISING A TUBULAR GUIDE ELEMENT, PARTICULARLY FOR A MACHINE FOR PROCESSING ELONGATE STRAND MATERIAL

CROSS REFERENCE TO RELATED APPLICATIONS

The application is a national stage application under 35 U.S.C. 371 and claims the benefit of PCT Application No. PCT/EP2015/068046 having an international filing dated 05 Aug. 2015. Which designated the United States, which PCT application claimed the benefit of German Patent Application No. DE 10 2014 011 772.3 filed 08 Aug. 2014, the disclosures of each of which are incorporated herein by reference in their entireties.

The present invention relates to a rotor bow, particularly for a machine for processing elongate strand material such as a bunching or a stranding machine for the bunching/stranding of elongate stranded material, as well as this type of machine comprising a rotor bow in accordance with the invention.

The stranded material is thereby preferably a metallic material such as a copper, steel or aluminum wire or an insulted or non-insulated metallic conductor of various alloy components or even a non-metallic material such as natural or plastic fiber, whereby multiple strands of such material is then bunched together by twisting; i.e. processed into a strand. The stranded material can, however, preferably also be such a strand, whereby multiple strands of such a strand are then likewise stranded together by twisting; i.e. processed into a cable or a rope.

For the sake of simplicity, the invention will be described in the following on the basis of a rotor bow for a wire bunching machine. This does not, however, constitute a limitation of any sort. The invention can equally apply to rotor bows for other machines such as, for instance, stranding machines which also process different elongate strand material.

With a bunching machine of the type under consideration herein, the bunching is effected by a rotating rotor which normally has one or more, generally curved, rotor bows which are mounted at their two axial ends to a one-piece or multi-part rotor shaft. At least two strands of the stranded material (of same or different type) are fed to the rotor and guided over a rotor bow, whereby the strands are twisted. The strand thereby produced is then led off of the rotor bow again.

The invention will be described in the following based on a machine having one rotor bow. This does not, however, constitute a limitation of any sort. The invention can equally apply to a machine having a plurality of rotor bows.

The rotor bow body can be made from various materials such as metal, plastic or also fiber-reinforced plastic. Its cross section is in each case preferably substantially lo rectangular, round, elliptical or even airfoil-shaped.

In the present application, unless stated otherwise, the cross section through the rotor bow or through its body always refers to a cross section perpendicular to the longitudinal extension of the rotor bow. Details on the form of the cross section are to be understood as not including any groove or other structural feature there might be which would result in a deviation from the basic geometrical form of the cross section.

To guide the stranded material along the rotor bow, prior art rotor bows have a continuous notch in the longitudinal direction of the rotor bow, which can be further provided with a slide plate on its inner surface to protect the body of the rotor bow from wear.

Further known from EP 1 612 325 B1 is centrally embedding a longitudinal wire guide tube of a wear-resistant material in a longitudinal groove on the inner flank of the rotor bow relative to the rotational axis for guiding the elongate strand material, whereby the width of the longitudinal groove is undersized with respect to the outer dimensions of the wire guide tube embedded into the longitudinal groove.

The problem which thereby arises is that the cross section of the wire guide tube has to be deformable in order to be pressed into the groove and its dimensions adapted to the latter and that considerable force and time is required in fitting and removing the wire guide tube.

The task on which the present invention is therefore based is that of providing a rotor bow having an easy-to-use, in particular easy to fit and remove, tubular guide element for guiding the elongate strand material as well as a machine for processing elongate strand material comprising such a rotor bow.

This task is solved by a rotor bow in accordance with claim 1 and a machine for processing elongate strand material in accordance with claim 15. Further advantageous implementations are set forth in the dependent claims.

A rotor bow according to the invention has a groove in its body which extends in the longitudinal direction of the rotor bow substantially over its entire longitudinal extension. A groove is to be understood in the usual sense of a continuous slot open on one longitudinal side and closed on the opposite longitudinal side which preferably exhibits substantially the same cross section at each point along its longitudinal extension.

The rotor bow according to the invention furthermore comprises a tubular guide element for guiding the elongate strand material, whereby the guide element is arranged in the groove without interruption and substantially over the entire longitudinal extension of the groove.

The respective guide element preferably has a substantially round, elliptical, rectangular, triangular or otherwise polygonal cross section. Preferably, the respective groove also has the corresponding substantially round, elliptical, rectangular, triangular or otherwise polygonal cross section, wherein a piece can then be "clipped" from the respective shape on the open side of the groove. At this point, the cross section of the guide element thus protrudes beyond the cross section of the groove.

Particularly preferentially, the open side of the groove is oriented in the cross section of the rotor bow perpendicular to the rotational direction of the rotor bow. This thereby enables achieving a particularly minimal expansion of the rotor bow cross section transverse to the rotor bow's rotational direction by virtue of the body of the rotor bow only having a wall on the closed side of the groove but not, however, on the open side of the groove adjacent to the guide element. So doing obtains a particularly small air contact surface and thus low air resistance in the rotor bow's direction of rotation.

According to the invention, the internal dimensions of the groove at any one point of the longitudinal extension of the guide element are greater than or equal to the external dimensions of the guide element at that point. This feature is to be understood as the groove—from the cross-sectional perspective—at least partly enclosing the guide element arranged within it such that the guide element has potentially only slight play at the given position. The guide element can, however, still be disposed in the groove without play over a certain part or even over its entire longitudinal extension, preferably if it was inserted into the groove at a certain pretensioning and partly slackens therein again due to the restoring forces, thereby being "clamped into position" in the groove.

The feature of the internal dimensions of the groove being larger than or equal to the external dimensions of the guide element at any one point allows the tubular guide element to be easily inserted into the groove of the rotor bow, preferably by pushing the guide element in through the open side of the groove or by inserting the guide element in from one end of the groove and similarly extracting it from the groove accordingly.

The inventive rotor bow can be economically manufactured as a single component since only one longitudinal groove needs to be machined and neither a longitudinal bore hole for a tubular guide element nor bore holes for securing discrete guide elements (grommets) need to be provided. Preferably, the groove is milled into the body of the rotor bow as the inventive rotor bow is being manufactured. The inventive rotor bow can also be economically furnished as a module since the assembly is simple, particularly since no grommets need to be produced or fit as guide elements. The tubular guide element, which concurrently forms the wear element, has a long service life but yet can be quickly and easily replaced if needed. The service life of the rotor bow's body is also increased by the tubular guide element as no lose wire ends can come into contact with the body and thus also not damage it.

In one preferential implementation of the invention, the guide element is positively connected to the body of the rotor bow by way of the groove over at least 60%, preferably over at least 70%, further preferably over at least 75%, as well as preferably over at most 90%, further preferably over at most 80% of the rotor bow's longitudinal extension.

Preferably, the form mating is produced by the groove extending around the guide element in the aforementioned region by more than the guide element's greatest diameter. When the guide element has, as is preferential, a circular cross section, the groove then preferably likewise has a circular cross section (with a circular segment "cut" from the open side of the groove) which is greater than a semicircle; i.e. its circumference encloses an angle of more than 180°. In other words, the cross section of the groove tapers in the region of the groove's open side. Should the guide element be introduced into or withdrawn from the groove through its open side in the aforementioned region of the rotor bow's longitudinal extension, the cross section of the guide element then needs to be slightly deformed, preferably by a gentle squeezing.

Preferably, the guide element can also be pushed into the groove or drawn out of the groove from one or both ends of the rotor bow body in its longitudinal direction.

Which of the cited introducing/extracting options are used for the guide element depends, inter alia, on the geometry of the machine into which the rotor bow is installed.

In a further preferential implementation of the invention, the cross section of the groove is configured with an overall length of at most 40%, preferably at most 30%, further preferably at most 25%, as well as preferably at least 10%, further preferably at least 20% of the rotor bow's longitudinal extension in at least one removal area such that the guide element can be removed from the body of the rotor bow at each point of the removal area in a removal direction extending perpendicular to the longitudinal extension of the rotor bow without deformation to the cross section of the guide element at this point.

This thereby enables the guide element to be easily removed out the groove in the removal area. In particular, the guide element within the removal area can then be removed out of the groove in the removal direction, the removed section of the guide element preferably grasped with the hand, and the entire guide element lastly pulled out of the groove in the longitudinal direction of the rotor bow.

Conversely, an end of the guide element can also be inserted into the groove in the removal area and then the entire guide element pushed into the groove in the longitudinal direction of the rotor bow. In so doing, the section of the guide element in the removal area not yet inserted into the groove is grasped by the hand and pushed forward. Lastly, the end of the guide element is inserted into the groove in the removal area opposite to the removal direction.

Particularly preferentially, the groove is designed such that the cross section of the groove does not taper on its open side, instead the cross section of the groove exhibits uniform width.

In one preferential variation of this implementation, at least one removal area is arranged in the region of one of the ends of the rotor bow.

In a further preferential variation of this implementation, a respective removal area is arranged in the region of both ends of the rotor bow.

In a further preferential implementation, at least one slot is arranged at least at one point in at least one removal area in the body of the rotor bow through which the guide element can be pushed in the removal direction. This additionally facilitates removing the guide element from the groove. Although the guide element can be pushed through the slot by hand, a suitable, preferably pin-like tool is preferential. Yet no special tool is required, rather a standard tool such as an Allen wrench or a screwdriver can be used.

The slot in the rotor bow body is preferably a notch or an indentation on the exterior of the rotor bow which runs in the removal direction and gives way into the groove at one end. Particularly preferentially, however, the slot is a through hole in the body of the rotor bow which gives way into the groove preferably at one end, preferentially centrically. Such a through hole, in particular one of small diameter, has a comparatively low weakening effect on the structural integrity of the rotor bow body.

In a further preferential implementation, the guide element is a spring, a coil spring, a Bowden cable sheath, a flexible shaft sleeve, a plastic tube, a steel tube or a hose. In so doing, already existing standard structural elements can be used as guide elements which enables economical replacement of said guide elements.

Preferably, the guide element is a coil spring of wire having a round cross section. Particularly preferentially, however, the guide element is a coil spring of wire having a substantially rectangular cross section, in particular a flat wire spiral. This yields a particularly tightly closed circumferential surface and high stability for the guide element as well as particularly good support for the elongate strand material within the guide element.

Further preferentially, the guide element is a coil spring of wire with a cross section which is substantially linear on the outer side of the coil spring and runs substantially parallel to the coil spring's longitudinal direction and exhibits a curvature at the inner side of the coil spring directed toward the interior of said coil spring. The elongate strand material thereby substantially comes into contact with the inner side of the guide element at each winding of the coil spring only at the innermost points of these curves, wherein the contact surface and thus the friction and wear are particularly low.

Further preferentially, the guide element is a coil spring of a wire having a cross section of basic rectangular shape and its cross section exhibits a curvature on the outer side of the coil spring directed toward the exterior or interior of the coil spring and a curvature on the inner side of the coil spring directed toward the interior of the coil spring.

In a further preferential implementation, the guide element is a coil spring, the coils of which are spaced apart from one another. Doing so enables the debris abraded by the guide element and/or from the elongate strand material to be blown out between the coils of the coil spring by the flow of air resulting from the rotating of the rotor bow.

In a further preferential implementation, at least the inner surface of the guide element is coated with a friction-reducing and/or anti-wear material, in particular Teflon, or provided with a friction-reducing and/or anti-wear hardening.

The cited implementations of the guide element as a coil spring have the advantage of the elongate strand material being well-supported in the interior of the guide element and the guide element being at the same time very wear-resistant.

In a further preferential implementation, the body of the rotor bow exhibits cross sections of different shape at different points along its longitudinal extension. Preferably, the body of the rotor bow thereby has a substantially elliptical cross section at least at one point and a substantially rectangular cross section at another point.

It is particularly preferential for a removal area to be arranged at each end of the rotor bow, for the rotor bow to at the same time have fixing elements at the removal areas for securing the rotor bow to the rotor of the machine, and that the cross section of the rotor bow body is substantially rectangular in the removal areas and substantially elliptical in the center region between the removal areas.

Doing so thus enables particularly easy attaching of the rotor bow to the respective mounting surfaces of the rotor by virtue of the flat sides of the removal areas. Correspondingly, also the fixing elements, preferably bore holes, can be produced particularly easily. The substantially elliptical cross section of the rotor bow in the center region on the other hand results in particularly low air resistance when the rotor bow rotates and thus to low energy consumption for the machine.

Further advantageous embodiments will follow from the description below in conjunction with the figures. Shown are:

FIG. 1:

a) a side view of a rotor bow according to the invention with associated fixing devices on the rotor of the machine;

b) a cross section through the center region of the rotor bow;

c) an enlarged view of the inlet and deflection end of the rotor bow;

FIG. 2:

a) a side view of the body of an inventive rotor bow;

b) an enlarged view of the inlet and deflection end of the rotor bow body as seen from underneath;

c) three cross sections of the rotor bow body through the center region, the intake end and the deflection end respectively;

FIG. 3:

a) an oblique view from the removal area of a section of an inventive rotor bow at the transition from the center region to a removal area during the inserting of a guide element;

b) the view of the rotor bow from FIG. 4*a*) with inserted guide element;

c) the view of the rotor bow from FIG. 4*a*) when the guide element is being pushed out of the removal area by a tool;

FIG. 4:

a) a section of a guide element in the form of a closed coil spring in oblique view and in cross section;

b) a section of a guide element in the form of an open coil spring in oblique view and in cross section;

c) four sections of guide elements in the form of wire coil springs of differing longitudinal cross sections;

FIG. 5:

a) a comparison table of power consumption values for a rotor bow according to the prior art and a rotor bow according to the invention at different twist rates;

b) depiction of the values from the FIG. 5*a*) table as a bar chart.

FIG. 1*a* shows a side view of a rotor bow 1 according to the invention having a body 2 which extends in curved form between a left inlet-side end (as the bunched or stranded elongate strand material enters into the rotor bow 1 at this end) and a right, deflection-side end (as the bunched or stranded elongate strand material is deflected at this end and led to a take-up reel). The body 2 of the rotor bow 1 consists of fiber-reinforced plastic in the example embodiment and is configured as a solid component without cavities (apart from a groove 3, fixing slots 8 and further bore holes as described further below).

The rotor bow is preferably suitable for the processing of bare, e.g. seven-wire strands, preferably of copper alloys such as CuMg, in particular CuMg02 (i.e. with a magnesium content of 0.2%), CuAg, CuSn or the like, having small cross sections of no more than 1.5 $mm^2$, at high twist rates, preferably 6500 twists per minute (corresponding to 3250 revolutions in a double-twist bunching machine). However, other materials having other material and/or process parameters, preferably twist rates of 7000 or more twists per minute, can also be processed.

The rotor bow is further preferably applicable to machines for spools of 630 mm diameter. However, the rotor bow is also suitable for other machine sizes, whereby larger-dimensioned machine sizes generally employ lower twist rates and smaller-dimensioned machine sizes generally employ higher twist rates.

An inlet-side removal area 5 is additionally provided at the inlet end of the rotor bow 1 as is a deflection-side removal area 6 at the deflection end of the rotor bow 1, which will be described in greater detail below.

FIG. 1*b* shows a cross section through the rotor bow 1 at the approximate center of its longitudinal extension. At this point, the body 2 of the rotor bow 1 exhibits a substantially elliptical cross section (when disregarding the groove 3). A groove 3 is embedded at the center of a longitudinal side of the cross section. The groove 3 has a circular cross section, from which a circular section smaller than a semicircle has been cut out at the open side of the groove 3. A tubular guide element 4 of circular cross section is arranged in the groove 3. In the example embodiment, the guide element 4 consists of a coil spring wound from spring steel wire. The groove 3 has a slightly larger diameter than the guide element 4 (not discernible in the figure) such that the guide element 4 has a small amount of play in the groove 3 and can thus be pushed into or out of the groove 4 in the longitudinal direction with little effort. The groove 3 encloses the guide element 4 in the cross section by more than half such that there is a positive connection between the guide element 4 and the groove 3.

FIG. 1*c* shows enlarged depictions of the inlet-side removal area 5 and the deflection-side removal area 6. The rotor bow 1 is affixed to the machine rotor in these areas by different fixing devices 7. Since the fixing devices 7 are only of lesser importance in the context of the present invention, they will not be described in any greater detail here.

The rotor bow 1 and thus also the groove 3 and the guide element 4 have a longitudinal extension of approximately 1672 mm in the example embodiment. The inlet-side removal area 5 has a longitudinal extension of approximately 226 mm and the deflection-side removal area 6 has a longitudinal extension of approximately 141 mm. The width of the rotor bow, corresponding to the long axis of the substantially elliptical cross section, or the long side of the substantially rectangular cross section respectively, amounts to approximately 28 mm, and the thickness of the rotor bow, corresponding to the short axis of the substantially elliptical cross section, or the narrow side of the substantially rectangular cross section respectively, amounts to approximately 6.5 mm. The inner diameter of the groove 3 is approximately 6.2 mm and the outer diameter of the guide element 4 is approximately 6 mm. The wall thickness of the body 2 between the closed side of the groove 3 and the opposite exterior of the body 2 amounts to approximately 1.4 mm.

Figure 2:
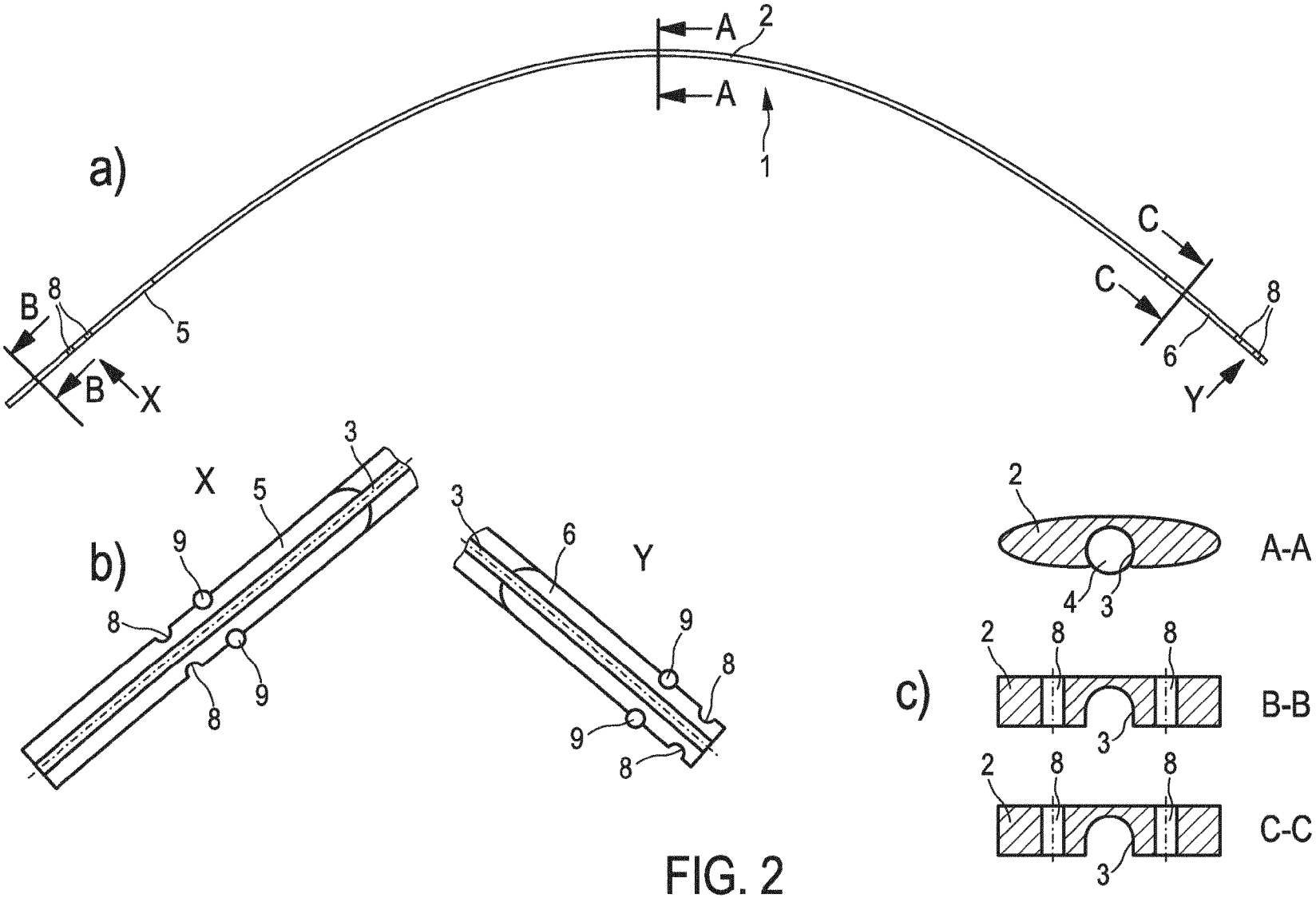

FIG. 2*a* shows an isolated depiction of the body 2 of an inventive rotor bow 1 in a side view.

Two fixing slots 8 can in each case be seen in the inlet-side removal area 5 and in the deflection-side removal area 6 on the front outer side of the body 2 depicted in FIG. 2*a*.

It can be seen from FIG. 2*b*, which shows the removal areas 5 and 6 in an enlarged depiction from underneath, two respective fixing slots 8 each of semicircular cross section are provided at the rotor bow's front side and rear side in each removal area 5, 6. A fastening clip 9 affixed to the rotor engages in these fixing slots 8 in order to secure the rotor bow 1 to the rotor. This does away with the need for further fixing elements on or in body 2 such as threading which could structurally weaken the fiber-reinforced plastic.

The body 2 of the rotor bow 1 has a substantially rectangular cross section in the respective removal areas 5, 6 and a substantially elliptical cross section in its center region between the removal areas 5, 6. This is again illustrated in the three sectional views of FIG. 2*c* by the center region, the inlet-side removal area 5 and the deflection-side removal area 6 respectively. However, different cross-sectional shapes are of course also possible in the respective areas.

Further seen in FIG. 2*c* is that the cross section of the groove 3 in the removal areas 5, 6 does not taper at the open side of the groove 3 as in the center region of the body 2 but rather exhibits straight lateral edges at the open side. This thereby enables the guide element 4—here with circular cross section to be easily inserted into and/or taken out of the removal area 5, 6.

Figure 3:
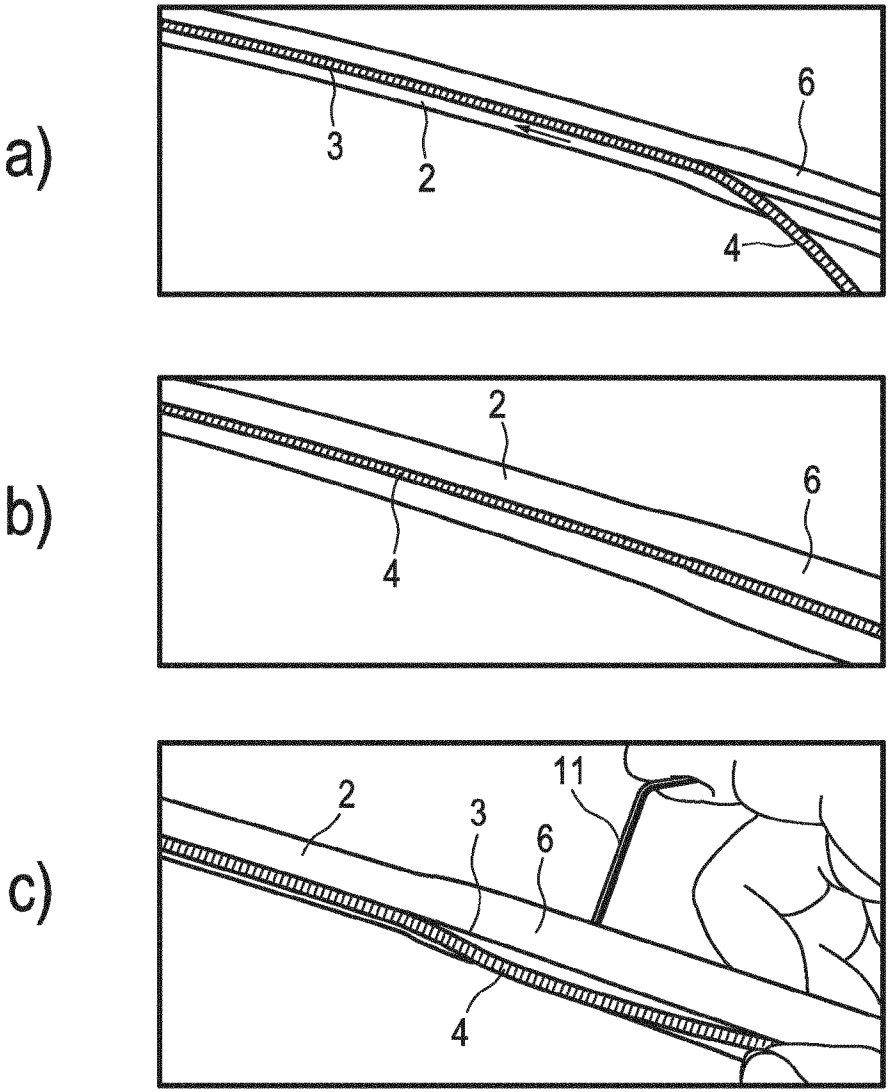

FIG. 3 again illustrates the insertion/removal procedure for the guide element 4.

Therein, FIG. 3*a* shows the body 2 of a rotor bow 1 at the transition between the central region and the deflection-side removal area 6 just as the guide element 4, in this case a wire coil spring, is being inserted through the removal area 6 into the groove 3 by being pushed in toward the other end of the rotor bow 1, indicated by the arrow.

FIG. 3*b* shows the body 2 with a fully inserted guide element 4.

FIG. 3*c* shows the body 2 just as a user is manually pushing the guide element 4 out of the removal area 6. The user is using a pin-like tool 11 here, preferably a simple Allen wrench, and presses it into the groove 3 through a (not shown) bore hole connecting the groove 3 to the opposite outer side of the body 2, whereby the guide element 4 can be pushed out of the groove 3 and thus easily removed manually.

This makes it very easy to replace the guide element 4, preferably upon it becoming worn, and without any special tool being required to do so.

Figure 4:
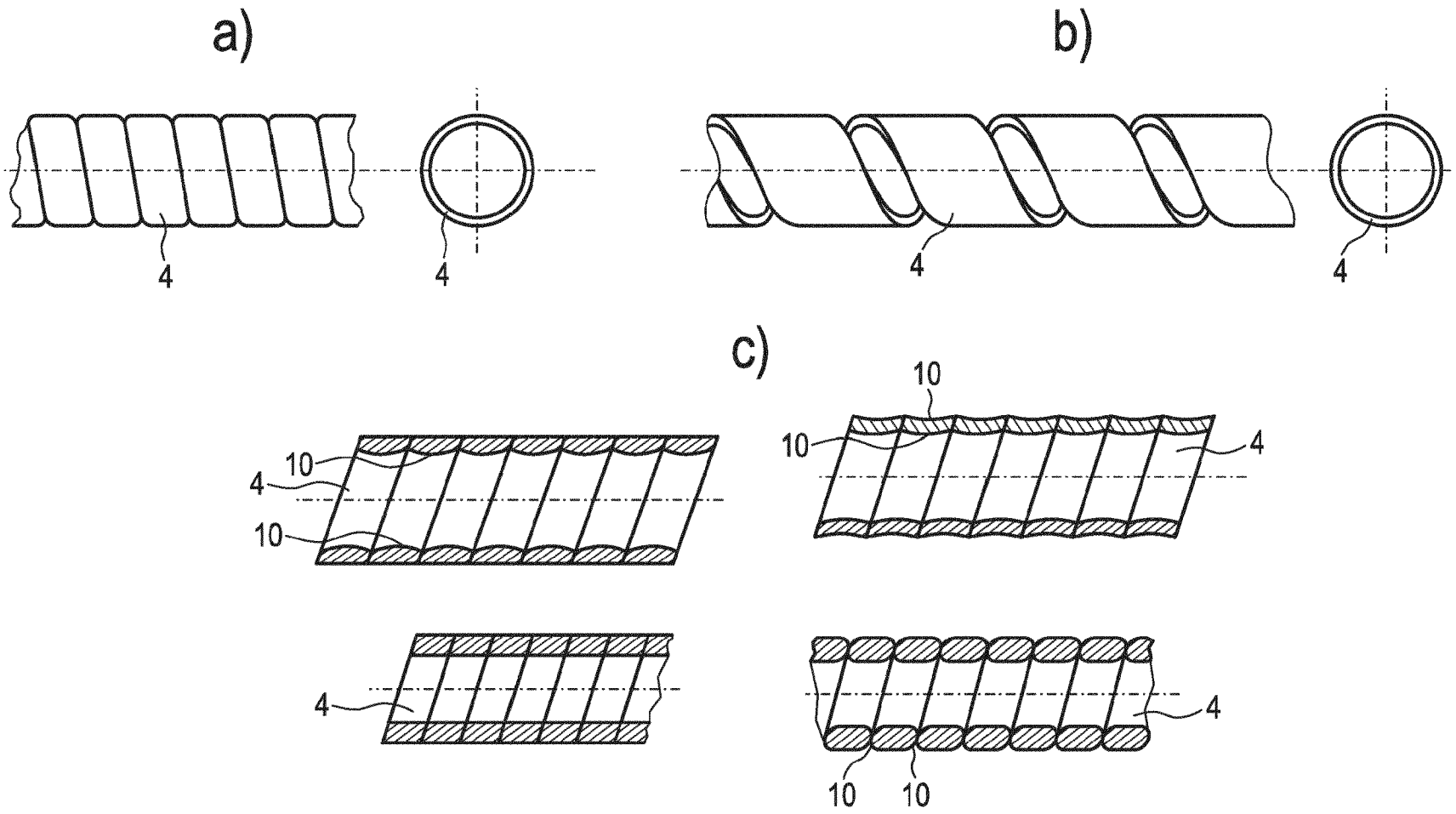

FIG. 4 shows two different variations of a guide element 4 configured as a coil spring, namely a closed coil spring in FIG. 4*a*, in which the coils are directly adjacent, as well as an open coil spring in FIG. 4*b*, in which there is free space between adjacent links. A respective perspective view as well as cross section are shown in each case.

FIG. 4*c* shows four different variations of a longitudinal section through a guide element 4 in the form of a coil spring: In the first variant (upper left representation), the cross section of the wire, from which the coil spring is wound, is linear at the outer side and convex at the inner side such that the curvatures 10 project into the interior of the guide element 4 and provide a smaller contact surface for the elongate strand material.

In the second variant (lower left representation), the flat wire coil spring is wound to have an approximate rectangular cross section, which lends particularly high stability to the coil spring.

In the third variant (upper right representation), the cross section of the wire exhibits concave curvatures 10 on the outer side and convex curvatures 10 on the inner side, all oriented toward the interior of the guide element 4.

In the fourth variant (lower right representation), the wire cross section is linear at the outer and inner side and exhibits convex curvatures 10 toward the front/rear on the front and rear side of the cross section when seen in the longitudinal direction of the guide element 4.

Figure 5:
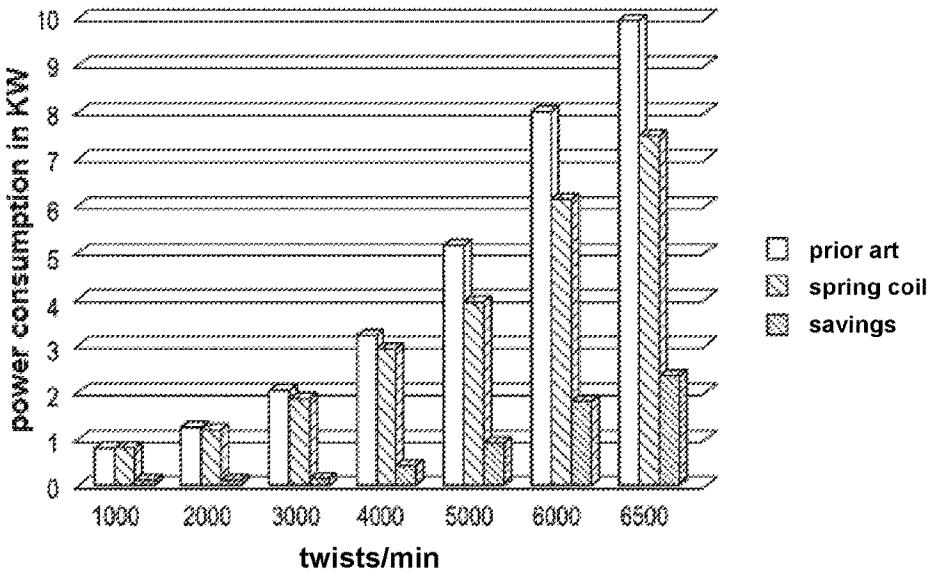

FIG. 5 constitutes a comparison of the power consumed by a bunching machine, wherein the machine is firstly equipped with a prior art rotor bow and then secondly with an inventive rotor bow provided with a spring coil as a guide element. The rotor bow from the prior art, on the other hand, comprises discrete guide elements which cover a groove in the body of the rotor bow at specific spacings, yet thereby protrude considerably beyond the cross section of the rotor bow body.

The same measured values are depicted in a table in FIG. 5*a* and as a bar chart in FIG. 5*b*.

To this end, the consumption values for various rotor bow twist rates (corresponding to double the respective number of revolutions in a double-twist bunching machine) of between 1000 and 6500 twists per minute (corresponding to 500 to 3250 revolutions) were measured. The power consumed in kW as well as the difference in performance values between the different rotor bows for the respective rotor bow at the respective number of twists is depicted in the three columns on the right in the table and by the three respective bars in the bar chart. One recognizes that particularly at high numbers of twists, a significant amount of power is saved with the rotor bow according to the invention.

LIST OF REFERENCE NUMERALS

1 rotor bow
2 rotor bow body

3 groove
4 guide element
5 inlet-side removal area
6 deflection-side removal area
7 fixing device
8 fixing slot
9 fastening clip
10 wire curvature
11 pin-like tool

The invention claimed is:

1. A rotor bow, particularly for a machine for processing elongate strand material, comprising a groove in a body of the rotor bow which extends in a longitudinal direction of the rotor bow substantially over an entire longitudinal extension of the rotor bow and a tubular guide element for guiding the elongate strand material, wherein the guide element is arranged in the groove without interruption and substantially over an entire longitudinal extension of the groove, wherein internal dimensions of the groove at any one point of a longitudinal extension of the guide element are greater than or equal to external dimensions of the guide element at that point, wherein a cross section of the groove is configured with an overall length of at most 40% as well as at least 10% of the longitudinal extension of the rotor bow in at least one removal area such that the guide element can be removed from the body of the rotor bow at each point of the removal area in a removal direction extending perpendicular to the longitudinal extension of the rotor bow without deformation to a cross section of the guide element at this point, wherein at least one slot is arranged at least one point in the removal area in the body of the rotor bow through which the guide element can be pushed in the removal direction.

2. The rotor bow according to claim 1, wherein the guide element is positively connected to the body of the rotor bow by way of the groove over at least 60%, preferably over at least 70%, further preferably over at least 75%, as well as preferably over at most 90%, further preferably over at most 80% of the longitudinal extension of the rotor bow.

3. The rotor bow according to claim 1, wherein the cross section of the groove is configured with the overall length of at most 30%, further preferably at most 25%, as well as preferably at the least 20% of the longitudinal extension of the rotor bow in the removal area.

4. The rotor bow according to claim 1, wherein the removal area is arranged in a region of one end of the rotor bow.

5. The rotor bow according to claim 4, wherein a respective removal area is arranged in the region of both ends of the rotor bow.

6. The rotor bow according to claim 1, wherein the at least one slot is a through hole in the body of the rotor bow.

7. The rotor bow according to claim 1, wherein the guide element is a spring, a coil spring, a Bowden cable sheath, a flexible shaft sleeve, a plastic tube, a steel tube or a hose.

8. The rotor bow according to claim 1, wherein the guide element is a coil spring of wire having a substantially round cross section.

9. The rotor bow according to claim 1, wherein the guide element is a wire coil spring having a cross section which is substantially linear on an outer side of the coil spring and runs substantially parallel to a longitudinal direction of the coil spring and exhibits a curvature at an inner side of the coil spring directed toward an interior of said coil spring.

10. The rotor bow according to claim 1, wherein the guide element is a wire coil spring having a cross section which is of basic rectangular shape and the cross section exhibits a curvature on an outer side of the coil spring directed toward an exterior or an interior of the coil spring and a curvature on an inner side of the coil spring directed toward the interior of the coil spring.

11. The rotor bow according to claim 1, wherein the guide element is a coil spring, the coils of which are spaced apart from one another.

12. The rotor bow according to claim 1, wherein at least an inner surface of the guide element is coated with a friction-reducing and/or anti-wear material, in particular Teflon, or provided with a friction-reducing and/or anti-wear hardening.

13. The rotor bow according to claim 1, wherein the body of the rotor bow exhibits cross sections of different shapes at different points along its longitudinal extension, in particular a substantially elliptical cross section at one point and a substantially rectangular cross section at another point.

14. A machine for processing elongate strand material comprising a rotor bow according to claim 1.

15. A rotor bow, particularly for a machine for processing elongate strand material, comprising a groove in a body of the rotor bow which extends in a longitudinal direction of the rotor bow substantially over an entire longitudinal extension of the rotor bow and a tubular guide element for guiding the elongate strand material, wherein the guide element is arranged in the groove without interruption and substantially over an entire longitudinal extension of the groove, wherein internal dimensions of the groove at any one point of a longitudinal extension of the guide element are greater than or equal to external dimensions of the guide element at that point, wherein the guide element is a wire coil spring having a cross section which is substantially linear on an outer side of the coil spring and runs substantially parallel to a longitudinal direction of the coil spring and exhibits a curvature at an inner side of the coil spring directed toward an interior of said coil spring.

16. A rotor bow, particularly for a machine for processing elongate strand material, comprising a groove in a body of the rotor bow which extends in a longitudinal direction of the rotor bow substantially over an entire longitudinal extension of the rotor bow and a tubular guide element for guiding the elongate strand material, wherein the guide element is arranged in the groove without interruption and substantially over an entire longitudinal extension of the groove, wherein internal dimensions of the groove at any one point of a longitudinal extension of the guide element are greater than or equal to external dimensions of the guide element at that point, wherein the guide element is a wire coil spring having a cross section which is of basic rectangular shape and the cross section exhibits a curvature on an outer side of the coil spring directed toward an exterior or an interior of the coil spring and a curvature on an inner side of the coil spring directed toward the interior of the coil spring.

* * * * *